United States Patent [19]

Ploetz et al.

[11] 4,401,296

[45] Aug. 30, 1983

[54] ELECTRO-METAL SMELTING FURNACE WITH TAPHOLE ARRANGED AT THE BOTTOM

[75] Inventors: Klaus V. Ploetz, Kaarst; Ludger Zangs, Essen; Ralf Schneider, Mettmann; Hannsgeorg Bauer, Witten; Josef Otto, Wetter; Manfred Walter, Witten; Helmut Meyer, Witten; Erich Heinrich, Witten, all of Fed. Rep. of Germany

[73] Assignee: Mannesmann DeMag AG, Duisburg, Fed. Rep. of Germany

[21] Appl. No.: 266,314

[22] Filed: May 22, 1981

Related U.S. Application Data

[63] Continuation of Ser. No. 153,897, May 28, 1980, abandoned.

[30] Foreign Application Priority Data

May 29, 1979 [DE] Fed. Rep. of Germany ..... 2921742

[51] Int. Cl.[3] ..... C21C 5/48

[52] U.S. Cl. ..... 266/236; 266/272

[58] Field of Search ..... 266/236, 272

[56] References Cited

U.S. PATENT DOCUMENTS

| | | | |
|---|---|---|---|
| 3,436,023 | 4/1969 | Thalmann | 266/236 |
| 3,507,483 | 4/1970 | Resch | 266/236 |
| 3,651,825 | 3/1972 | Sury | 266/236 |
| 3,877,675 | 4/1975 | Shapland | 251/144 |
| 4,116,372 | 9/1978 | Horiguchi et al. | 222/600 |
| 4,232,855 | 11/1980 | Hartl | 266/272 |

FOREIGN PATENT DOCUMENTS

| | | | |
|---|---|---|---|
| 812216 | 4/1959 | United Kingdom | 266/236 |
| 866928 | 5/1961 | United Kingdom | 266/236 |
| 1033889 | 6/1966 | United Kingdom | 266/236 |
| 1154054 | 6/1969 | United Kingdom | 266/236 |
| 1159736 | 7/1969 | United Kingdom | 266/236 |
| 1475713 | 6/1977 | United Kingdom | 266/236 |

*Primary Examiner*—P. D. Rosenberg

*Attorney, Agent, or Firm*—Mandeville and Schweitzer

[57] ABSTRACT

The invention concerns an electro-metal smelting furnace with at least one taphole located at the bottom with which hole is associated a closure equipped with a drive.

3 Claims, 6 Drawing Figures

(A-A)

(E-E)

(C-C)

ELECTRO-METAL SMELTING FURNACE WITH TAPHOLE ARRANGED AT THE BOTTOM

This is a continuation of application Ser. No. 153,897, filed May 28, 1980, now abandoned.

BACKGROUND AND SUMMARY OF THE INVENTION

Customarily electro reduction furnaces are provided with tapholes in the area of the bottom which are closed by means of a taphole gun which presses an appropriate plastic medium into the taphole. For tapping, the opening is bored or burned open. The closing and in particular the opening of the taphole demands a certain amount of time since, first of all, the tap gun or boring machine has to be positioned in working position. Furthermore it necessitates that there be space corresponding to the movement of the machines within the proximity of the tapholes.

It is a known fact that pouring ladles are to be provided with a discharge outlet. In connection with known model types, this is a stable plate which is associated with the ladle, which plate has an opening to which is fastened a second plate which may be moved which also has a corresponding opening, may be slid away. When the container is to be emptied the openings in the plates are aligned with each other; when the movable plate is slid aside, the opening is closed. With this model type it is necessary, that the plates lie close together so that no liquidmetal may enter between them and interfere with the tightness of the closure. For all that, this may not always be avoidable. Even an installation which presses the movable plate against the stable one does not result in any material improvement.

It is the aim of the invention to improve an electro-metal smelting furnace of the above-mentioned type in such a way that the tapping of the metal smelt may be carried out faster and with fewer problems. This aim is achieved according to the invention through application of the characteristics in the claims.

As practice has demonstrated, the tapping periods are materially shortened through the use of a simple closure developed like a type of shutter. Since the plate which closes the taphole is swung away from the pouring spray when opening there is no abrasion. The counter surface against which the shutter rests when in closure position may be fittingly developed in such a way that it stays free from the metal which pours through the hole. It is appropriate after tapping and prior to processing the new smelt to fill the pipe-shaped taphole which passes through the furnace lining, with a pourable material, for instance sand, which under the effect of the heat from the smelt cakes together and prevents the metal from directly affecting the closure shutter. This material may be chosen with a view to fracturing when opening the closure shutter and thereby releasing the taphole.

An example of an embodiment of the invention is shown in the drawing:

It shows:

DESCRIPTION OF THE INVENTION

Figure 1:
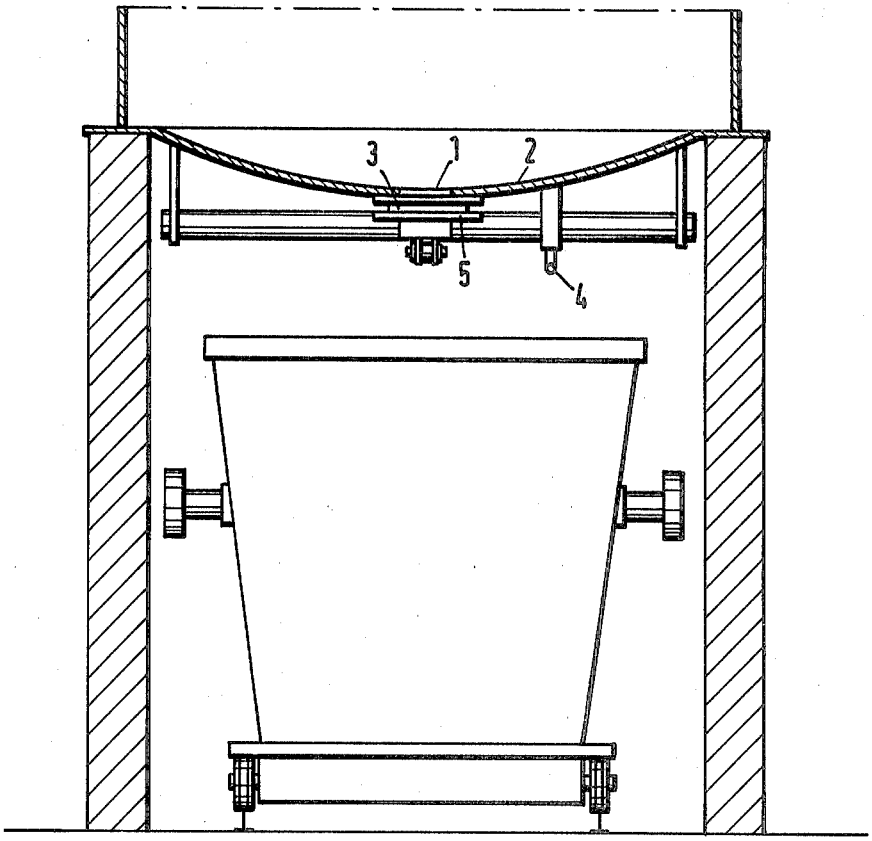
FIG. 1 is the device in view.

FIG. 1 shows a taphole 1 at the underside of the container of an electro-metal smelting furnace, which taphole ends into a socket 3 protruding downward from the container bottom 2. Below the container bottom 2 is designed a movement drive 4 to which is fastened a shutter 5 in closure position, which shutter rests against the taphole 1.

Figure 2:
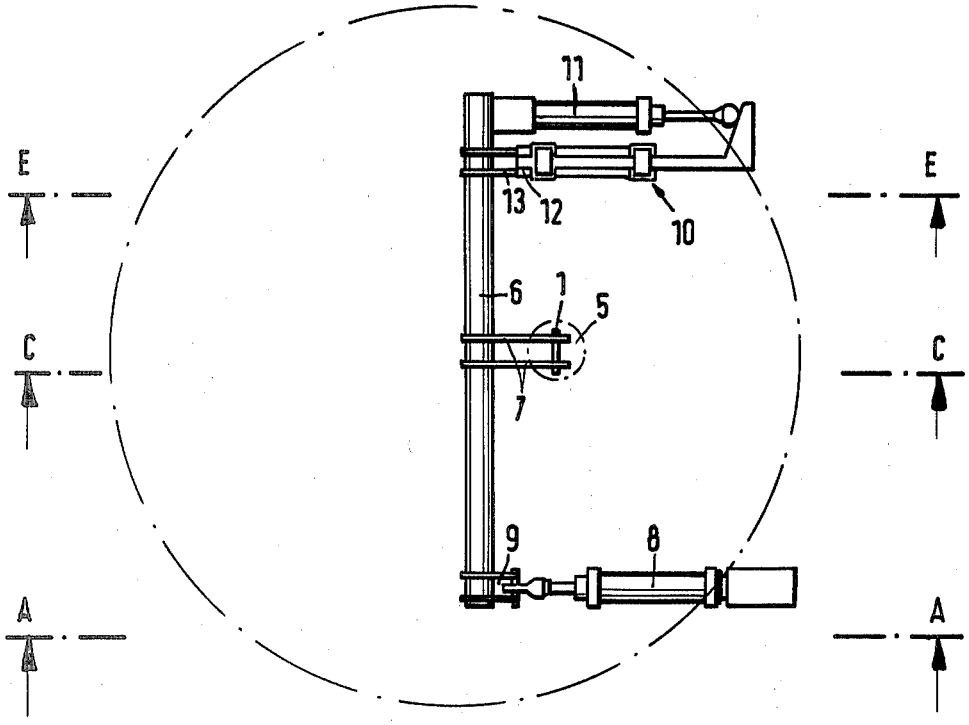
FIG. 2 is the design according to FIG. 1 in plan view.

As shown in FIG. 2, a horizontal shaft 6 extends laterally offset to the taphole 1 below the furnace container. At about the middle there are two levers 7 parallel to each other connected to the shaft 6, at the end of which is associated the closure plate 5, proper. The shifting of the shaft 6 and thereby of the closure shutter is done by way of a piston-cylinder unit 8, which according to FIG. 2, with its piston rod catches a lever 9 which lever is fixedly connected with the shaft 6; this unit hinges with its other end onto the furnace container.

A bolting apparatus 10 is provided for the opposite end of the shaft which apparatus consists of a second piston cylinder unit 11 which in closing position of shutter 5 slides wedge 12 into the path of the movement of an eccentric pin 13 which is connected with the shaft, thereby immobilizing the shaft 6.

Figure 3:
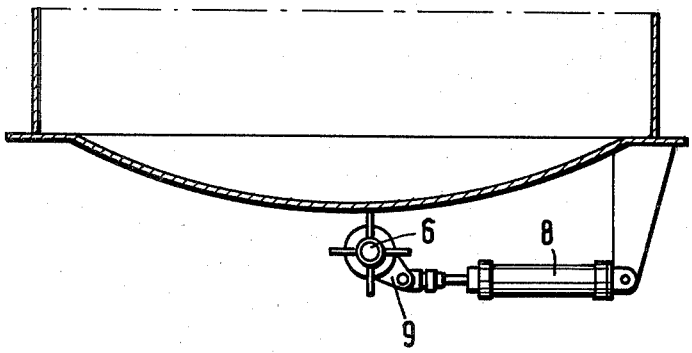
FIGS. 3 to 6 are several vertical cuts through FIG. 2.
Figure 4:
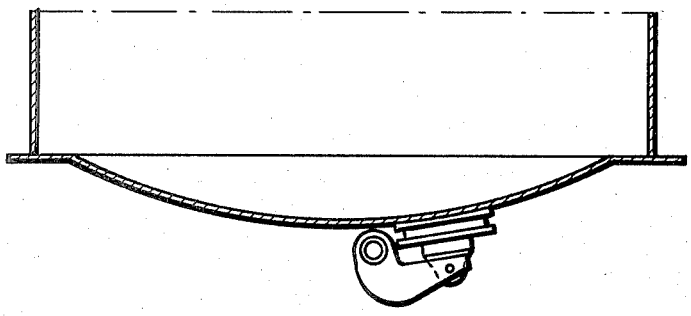

The installation of the drive for opening and closing the bottom closure may be seen in FIG. 3. The development of the closure shutter and the installation of the levers which are rigidly connected with the shaft may be seen from FIG. 4 in which the shutter is shown in closing position.

Figure 5:
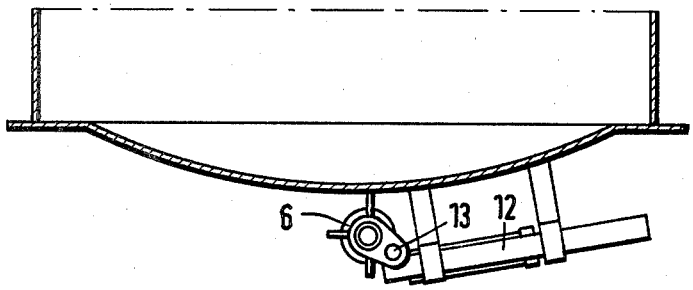

FIG. 5 shows the wedge 12 which may be slid longitudinally and which secures the bottom closure in closure position: which wedge locks in that position below an eccentric pin which is fixedly connected with the shaft. The longitudinal movement of the wedge completes the piston-cylinder unit 11, as illustrated in FIG. 2, which unit is built in parallel to the movement direction of the wedge 12.

Figure 6:
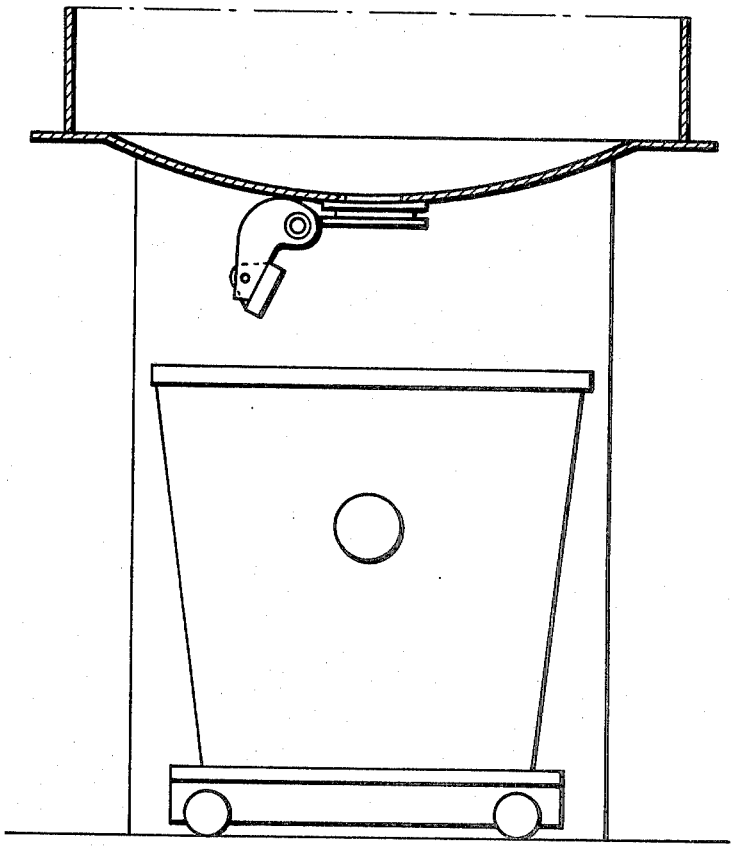

FIG. 6 shows the opened bottom closure.

In case the electro-metal smelting furnace is to be equipped with several tapholes in the bottom or in the proximity of the bottom, for instance because when tapping a sump it is to be kept upright, there will be no difficulties to install several of the space-saving shutter closures according to the invention.

We claim:

1. Electro-metal smelting furnace comprising:

(a) a furnace bottom having at least one taphole, (b) a closure plate pivotable between a remote position and a sealing position against the underside of the taphole, (c) a shaft associated with said furnace and positioned to the side of said taphole at the underside of said furnace bottom, (d) a lever connecting said closure plate to said shaft, (e) a first cylinder-piston unit subject to a pressure medium engaging said shaft at one of its ends and engaging a stationary frame element at its other end, (f) an eccentric pin fixedly connected to said shaft, (g) a wedge slideably movable between a locking position in the path of movement of said eccentric pin and a non-locking position outside the path of movement of said eccentric pin, (h) a second cylinder piston unit subject to a pressure medium associated with said wedge, whereby action of said first cylinder piston unit upon the fixed lever causes rotation of said shaft thereby pivotally moving said closure plate between the remote position and the sealing position and whereby action of said second cylinder piston unit upon said wedge causes said wedge to slide between the locking position and the non-locking position.

2. The electro-metal smelting furnace according to claim 1 further comprising movement accommodation means connecting said plate to said lever to accommodate limited movement of the plate with respect to the lever.

3. The electro-metal smelting furnace according to claim 1, further comprising:

(a) means of control which activates the second cylinder-piston unit to slide the wedge into the path of the eccentric pin for bolting purposes when closing the closure means and means of control activates the second cylinder-piston unit to slide the wedge out of the path of the eccentric pin for unbolting purposes when opening the closure means.

* * * * *